US007602368B2

(12) United States Patent
Chen et al.

(10) Patent No.: US 7,602,368 B2
(45) Date of Patent: Oct. 13, 2009

(54) RESET DEVICE AND METHOD FOR A SCAN DRIVER

(75) Inventors: Chien-Pin Chen, Hsinhua (TW); Jang Ting Chen, Hsinhua (TW)

(73) Assignee: Himax Technologies, Inc., Hsinhua (TW)

( * ) Notice: Subject to any disclaimer, the term of this patent is extended or adjusted under 35 U.S.C. 154(b) by 926 days.

(21) Appl. No.: 11/175,007

(22) Filed: Jul. 5, 2005

(65) Prior Publication Data

US 2006/0001639 A1 Jan. 5, 2006

(30) Foreign Application Priority Data

Jul. 5, 2004 (TW) ..... 93120165 A

(51) Int. Cl.
*G09G 3/36* (2006.01)

(52) U.S. Cl. ..... 345/100; 345/204

(58) Field of Classification Search ..... 345/98–100, 345/204, 60, 211–213; 327/333; 326/80
See application file for complete search history.

(56) References Cited

U.S. PATENT DOCUMENTS 7,256,778 B1 * 8/2007 Choi ..... 345/213
7,283,116 B2 * 10/2007 Shih et al. ..... 345/100
7,379,045 B2 * 5/2008 Morita ..... 345/98

* cited by examiner

*Primary Examiner*—Abbas I Abdulselam
(74) *Attorney, Agent, or Firm*—Ladas and Parry LLP

(57) ABSTRACT

The invention relates to a reset device for a scan driver. The scan driver is used for driving a control circuit of a display. The reset device comprises: a first input terminal, a second input terminal and a reset circuit. The first input terminal receives a first input voltage. After the first input voltage inputs to the first input terminal, the second input terminal receives a second input voltage. The second input voltage has a temporary section and a stable section. At the stable section, the second input voltage is larger than the first input voltage. When the first input terminal receives the first input voltage, the reset circuit outputs a reset signal to the scan driver. When the second input voltage is larger than a threshold value at the temporary section, the reset circuit clears the reset signal. According to the reset device of the invention, the scan driver maintains at a reset state so as to prevent that outputs of the scan driver to be at high level at the same time of supplying power. Therefore, the reset device can lower the malfunction of the control circuit and decrease the probability of damage and breakdown to maintain normal operation and life of the control circuit can be maintained.

19 Claims, 9 Drawing Sheets

RESET DEVICE AND METHOD FOR A SCAN DRIVER

BACKGROUND OF THE INVENTION

1. Field of the Invention

The present invention relates to a reset device and method thereof, particularly to a reset device for a scan driver and method thereof.

2. Description of the Related Art

With reference to FIG. 1, a scan driver 11 and a data driver 12 are used for controlling a liquid crystal display (LCD) to display desired images. For example, the scan driver 11 has 256 gate drive lines (G1, G2, . . . , G256) for sequential scanning in order to control pixels of the LCD which are controlled by the corresponding thin-film transistors (TFT). The scan drive lines are connected to the gates of the corresponding TFTs to control on/off of these TFTs. The data driver 12 sends a control signal to the corresponding TFTs to control the color and tone of pixels, so as to display the desired images on the LCD.

Generally, a conventional scan driver 11 has 256 registers 111, 112 and so on to control 256 gate drive lines in a one-to-one manner. The outputs of the 256 registers in the scan driver 11 cannot be determined to be at high or low level when initially supplying power to the scan driver 11. Therefore, if multiple outputs of the registers are at high level at the same time of supplying power, it will result in an inrush current, which will cause malfunction of the circuit or damage, even breakdown of the integrated circuit.

Therefore, it is necessary to provide a reset circuit and method thereof to solve the above problems.

SUMMARY OF THE INVENTION

The object of the present invention is to provide a reset device for a scan driver. The scan driver is used for driving a control circuit of a display. The reset device comprises: a first input terminal, a second input terminal and a reset circuit. The first input terminal receives a first input voltage. After the first input voltage inputs to the first input terminal, the second input terminal receives a second input voltage. The second input voltage has a temporary section and a stable section. At the stable section, the second input voltage is larger than the first input voltage. When the first input terminal receives the first input voltage, the reset circuit outputs a reset signal to the scan driver. When the second input voltage is larger than a threshold value at the temporary section, the reset circuit clears the reset signal.

According to the reset device of the invention, the reset circuit sends a reset signal to the scan driver after the first input voltage of the low voltage inputs to the first input terminal so as to maintain the scan driver at a reset state, and prevent the outputs of the scan driver to be at high level at the same time of supplying power. Therefore, the reset device can lower the malfunction of the control circuit and decrease the probability of damage and breakdown to maintain normal operation and life of the control circuit.

In addition, the reset device of the present invention further comprises a retaining circuit for maintaining the reset signal at a clear state after the reset signal is cleared, which prevents the possibility of the malfunction of the scan driver resulted from re-sending the reset signal to the scan driver when the second input voltage is unstable and the amplitude of the second input voltage is lower than the threshold value, thereby improving the reliability of the reset circuit of the present invention.

DETAILED DESCRIPTION OF THE INVENTION

With reference to the drawings, the reset device and circuit of an embodiment of the present invention are illustrated below. The same or similar element numerals and names are used to indicate the same or similar elements appearing in one or more of the figures.

Figure 1:
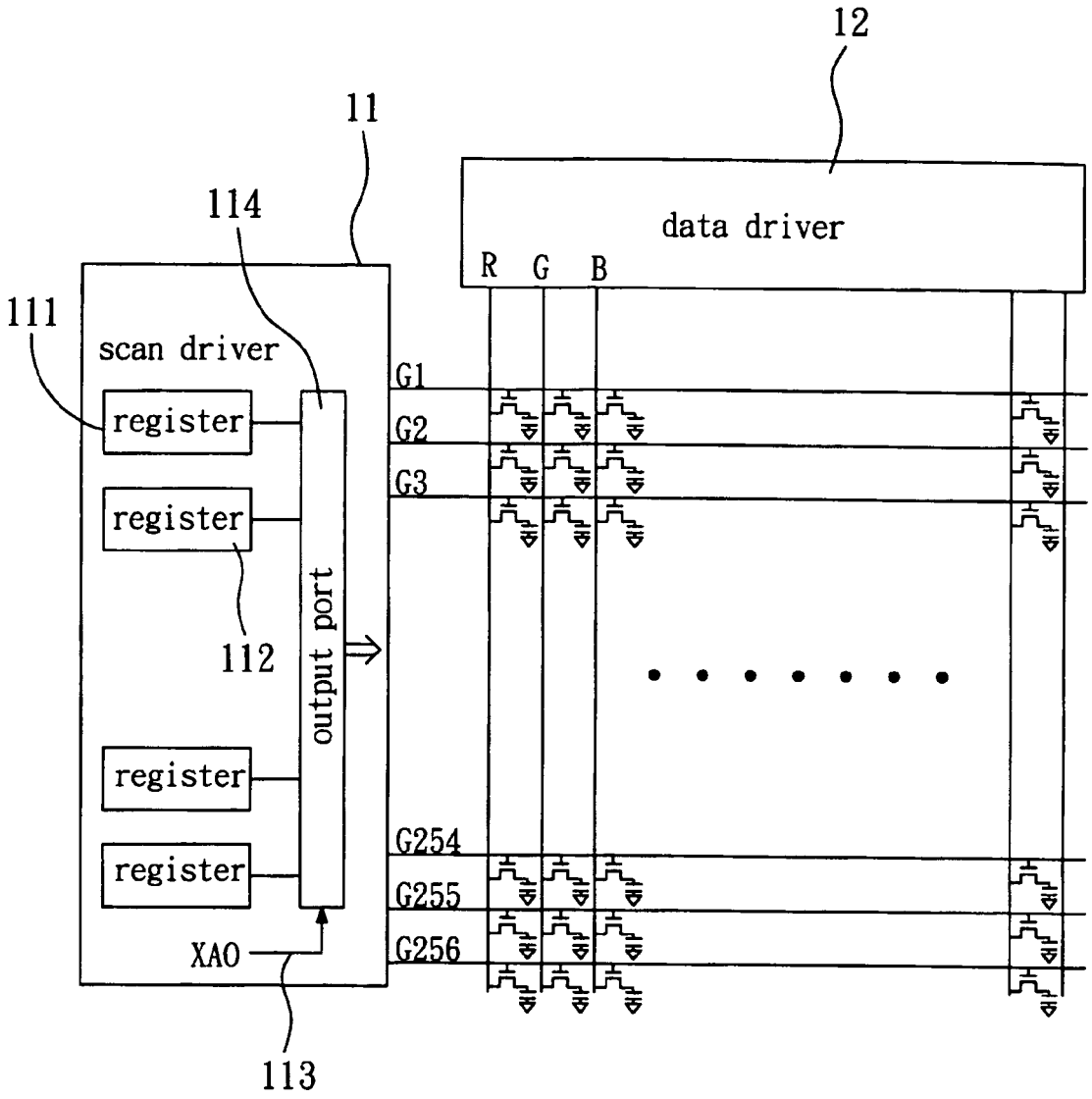
FIG. 1 is a schematic structural view of a conventional display using a scan driver and a data driver to control TFT.
Figure 2:
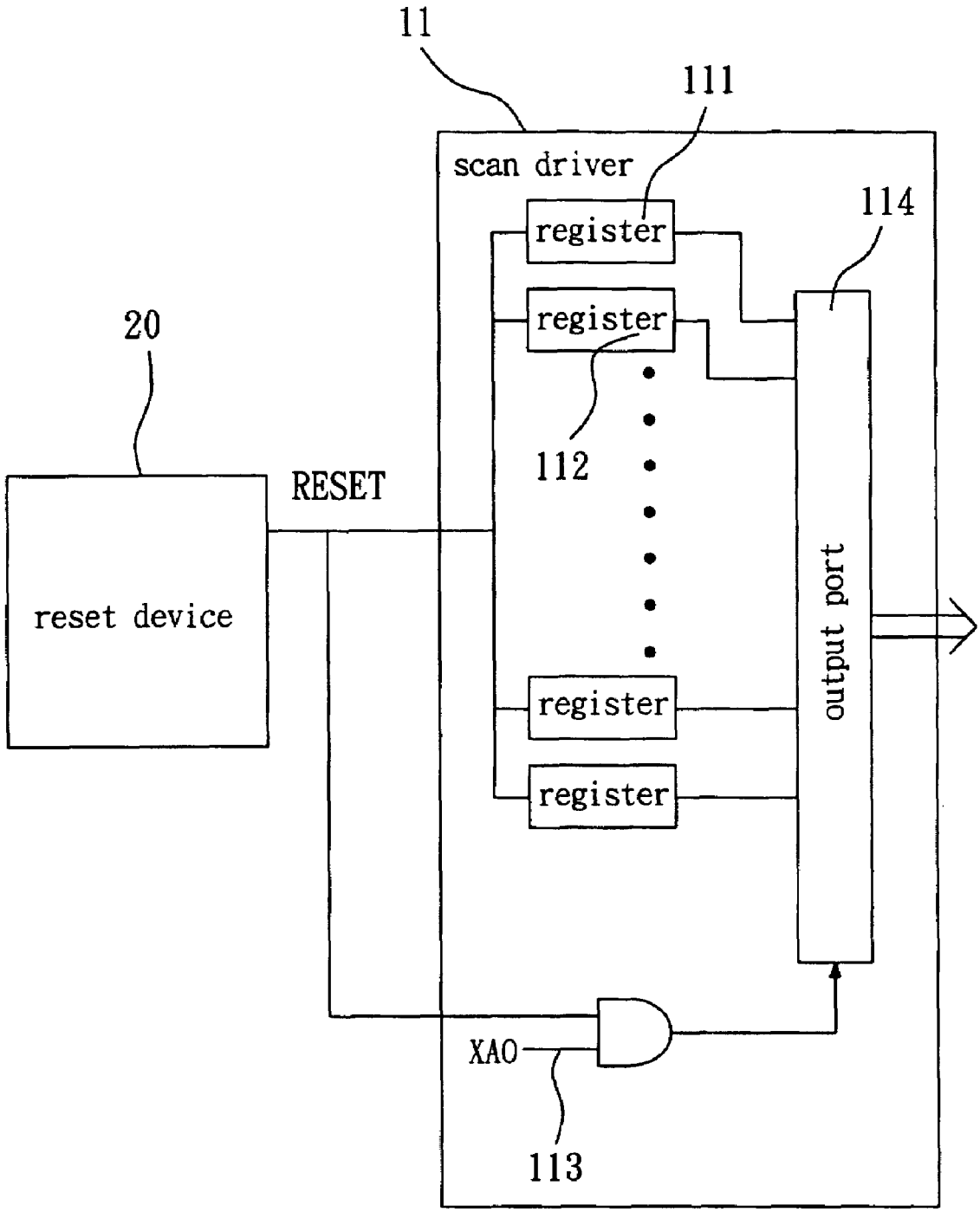
FIG. 2 is a schematic view of a reset device for a scan driver according to the present invention.

Now referring to FIG. 2, it is a schematic view of a reset device 20 for a scan driver according to the present invention. The reset device 20 of the present invention can be used to reset the control of 256 registers 111, 112 in a scan driver 11, an internal control signal (XAO) 113, etc. Generally, the 256 registers 111, 112 in the scan driver 11 control 256 gate drive lines via an output port set 114 in a one-to-one manner. The internal control signal 113 is a signal that forces all outputs to be at high level, here which is only for illustrative purposes, and not limited to the condition that the internal control signal had to be reset. Therefore, when the power is supplied to the scan driver 11 initially, it is necessary to reset the 256 registers 111, 112 in the scan driver 11 and the internal control signal 113, to low level, in order to ensure the normal operation of the circuit.

Figure 3:
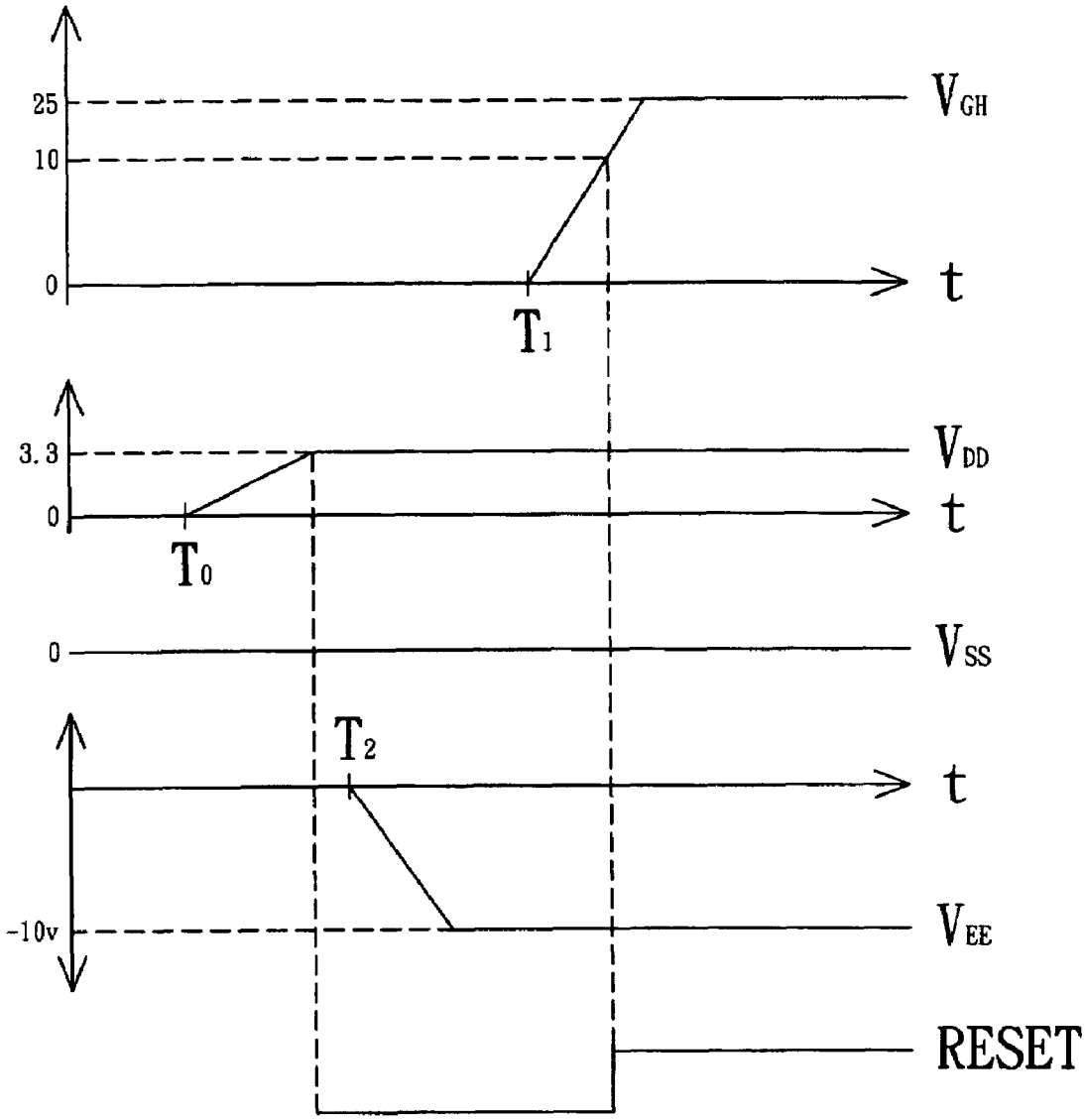
FIG. 3 is a schematic view of a reset control time sequence according to the present invention.

With reference to FIG. 3, it is a schematic view of the reset control time sequence of the present invention. Taking the scan driver as an example, a first input voltage $V_{DD}$, which is a low voltage power supply with amplitude usually from 3 to 5 V, first inputs at $T_0$. After the first input voltage $V_{DD}$ is stable, the reset signal RESET outputs low level (L), so as to reset the 256 registers 111, 112 in the scan driver 11 and the internal control signal 113.

A second input voltage $V_{GH}$ inputs at the time $T_1$, which is $(T_1-T_0)$ later than the time at which the first input voltage $V_{DD}$ inputs. The second input voltage $V_{GH}$ is a high voltage power supply, and has a temporary section and a stable section. At the stable section of the second input voltage, the amplitude is usually from 10 to 25 V, which is larger than the first input voltage. When the voltage of the second input voltage $V_{GH}$ at the temporary section is larger than a threshold value (10 V according to the present embodiment), the reset signal RESET outputs high level (H) to clear the reset signal, such that the 256 registers 111, 112 in the scan driver 11 and the internal control signal 113 can operate normally. In the present embodiment, the temporary section of the second input voltage $V_{GH}$ may be from 0 to 10 V, and the stable section of the second input voltage $V_{GH}$ may be from 10 to 25 V, for example. That is, when the voltage of the second input voltage $V_{GH}$ is smaller than the threshold value, the second input voltage $V_{GH}$ is on the temporary section; and when the voltage of the second input voltage $V_{GH}$ is higher than the threshold value, the second input voltage $V_{GH}$ is on the stable section.

A third input voltage $V_{EE}$ inputs at the time $T_2$, which is $(T_2-T_0)$ later than the time at which the first input voltage $V_{DD}$ inputs, but earlier than the time at which the second input voltage $V_{GH}$ inputs. The third input voltage $V_{EE}$ is a power supply of a medium voltage with amplitude usually from 5 to 10 V (−10 V according to the present embodiment). The third input voltage $V_{EE}$ can be a reference power supply, and the amplitude of the third input voltage can be the threshold value.

As shown in FIG. 3, under the control of a plurality of power supply input time sequences, the reset signal can be properly generated, such that once the first input voltage $V_{DD}$ is stable, the reset signal to the 256 registers 111, 112 in the scan driver 11 and the internal control signal 113 are generated so as to reset all of them to low level preventing the damage caused by the inrush current to the circuit when the outputs of a plurality of registers are at high level. Also, after the input of the second input voltage $V_{GH}$ is larger than a threshold value, the reset signal is cleared, such that the 256 registers 111, 112 in the scan driver 11 and the internal control signal 113 can receive the control signal of the system and operate normally. A circuit is used to achieve the control function of the reset device 20 of the present invention, in order to control the generation and clearance of the reset signal with the time sequences of a plurality of power supply inputs, as shown in FIG. 3.

Figure 4:
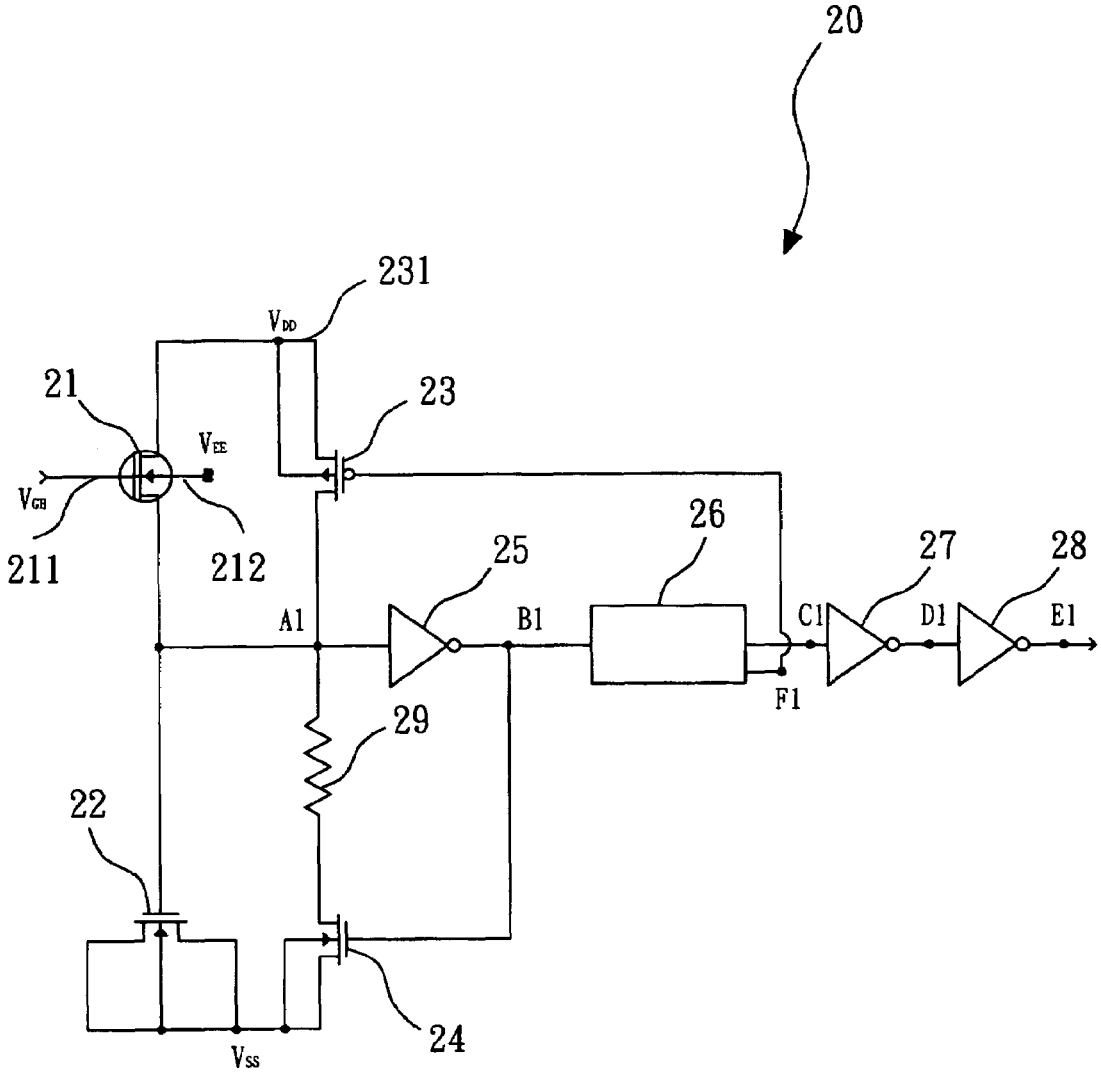
FIG. 4 is an equivalent circuit diagram of a reset device of a first embodiment of the present invention.

With reference to FIG. 4, it is an equivalent circuit diagram of the reset device 20 of the first embodiment of the present invention. The reset device 20 has a first input terminal 231 and a second input terminal 211. The first input terminal 231 receives a first input voltage $V_{DD}$. After the first input voltage $V_{DD}$ inputs to the first input terminal 231, the second input terminal 211 receives a second input voltage $V_{GH}$. The input time sequence and amplitudes of these input voltages are shown in FIG. 3. $V_{SS}$ is a ground terminal.

The reset device 20 further comprises a reset circuit which sends a reset signal to the scan driver after the first input voltage inputs and clears the reset signal after the input of the second input voltage is larger than a threshold value. The reset circuit comprises a high voltage N-type metal oxide semiconductor (NMOS) transistor 21, a first low voltage NMOS transistor 22, a P-type metal oxide semiconductor (PMOS) transistor 23, a second low voltage NMOS transistor 24, a resistor 29, a first inverter 25, a second inverter and level elevator 26, a third inverter 27 and a fourth inverter 28.

The high voltage NMOS transistor 21 has a gate 211 and a gate reference power supply terminal 212. The gate 211 is the second input terminal 211, and the gate reference power supply terminal 212 receives a third input voltage $V_{EE}$ which is the threshold value. The on/off of the high voltage NMOS transistor 21 is controlled by the second input voltage, and thereby obtains a first control signal A1.

That is to say, after the first input voltage $V_{DD}$ inputs to the first input terminal 231, and before the second input voltage $V_{GH}$ inputs or as its amplitude is smaller than that of the third input voltage $V_{EE}$, the high voltage NMOS transistor 21 is off, and the first control signal A1 is low level (L). The first control signal A1 is inverted by the first inverter 25, and thereby obtains a second control signal B1. Here, the second control signal B1 is high level (H).

The second control signal B1 is inverted by the second inverter and level elevator 26, and thereby obtains a third control signal C1. The level of the third control signal C1 is elevated to a work voltage level that is the work voltage level of the registers in the scan driver, usually from about 10 to 25 V. The third control signal C1 is low level (L).

The third control signal C1 is inverted by the third inverter 27, and thereby obtains a fourth control signal D1. Here, the fourth control signal D1 is high level (H). The fourth control signal D1 is inverted by the fourth inverter 28, and thereby obtains a fifth control signal E1, i.e. the reset signal RESET. Here, the fifth control signal E1 is low level (L).

Therefore, before the second input voltage $V_{GH}$ inputs or when its amplitude is smaller than that of the third input voltage $V_{EE}$, the fifth control signal E1 is low level (L), and is in accordance with the time sequence of the reset signal RESET in FIG. 3. The fifth control signal E1 can be connected to and will reset the 256 registers 111, 112 in the scan driver 11 and the internal control signal 113.

When the amplitude of the second input voltage $V_{GH}$ is larger than that of the third input voltage $V_{EE}$, the high voltage NMOS transistor 21 is on, such that the first control signal A1 is at high level (H), and charges the capacitor formed by the first low voltage NMOS transistor 22, to maintain the first control signal A1 at a high level and prevent the high voltage NMOS transistor 21 from being off again, which results in the malfunction of outputting the reset signal again when the input of the second input voltage $V_{GH}$ is unstable and its amplitude is smaller than that of the third input voltage $V_{EE}$.

When the first control signal A1 is at high level (H), the fifth control signal E1 is high level (H) because the first inverter 25, the second inverter and level elevator 26, the third inverter 27 and the fourth inverter 28, to make the reset signal are a time sequence of high level when the input amplitude of the second input voltage $V_{GH}$ is larger than the threshold value (the third input voltage $V_{EE}$), as shown in FIG. 3.

The reset device 20 of the present invention is further disposed with a PMOS transistor 23 as a capacitor besides the first low voltage NMOS transistor 22, in order to further prevent the high voltage NMOS transistor 21 from being off again and the malfunction of outputting the reset signal again when the input of the second input voltage $V_{GH}$ is unstable, and its amplitude is suddenly smaller than that of the third input voltage $V_{EE}$ after the reset signal is cleared as its amplitude is larger than that of the third input voltage $V_{EE}$. The PMOS transistor 23 is connected between the first control signal A1 and a sixth control signal F1. The sixth control signal F1 is an output of the second inverter and level elevator 26, and in phase with the second control signal B1. That is to say, when the first control signal A1 is at high level (H), the second control signal B1 and the sixth control signal F1 are at low level (L), the PMOS transistor 23 is on, and the first control signal A1 is forced to be at high level (H). Therefore, once the first control signal A1 is at high level (H), it will be forced to be at high level (H) under the influence of the PMOS transistor 23, no matter whether the high voltage NMOS transistor 21 is on or not, and thereby maintains the reset signal at the clear state. The PMOS transistor 23, i.e. a retaining circuit, can maintain the reset signal at the clear state after the reset signal is cleared.

Therefore, as the above illustration of the circuit action, the function of generating the reset signal by the time sequence and amplitude control of a plurality of power supplies in FIG. 3 can be achieved according to the equivalent circuit in FIG. 4. Meanwhile, the voltage level of the reset signal can be elevated to a practical work voltage level, and the reset device 20 employs a plurality of inverters to make the circuit stable and avoid the malfunction.

Figure 5:
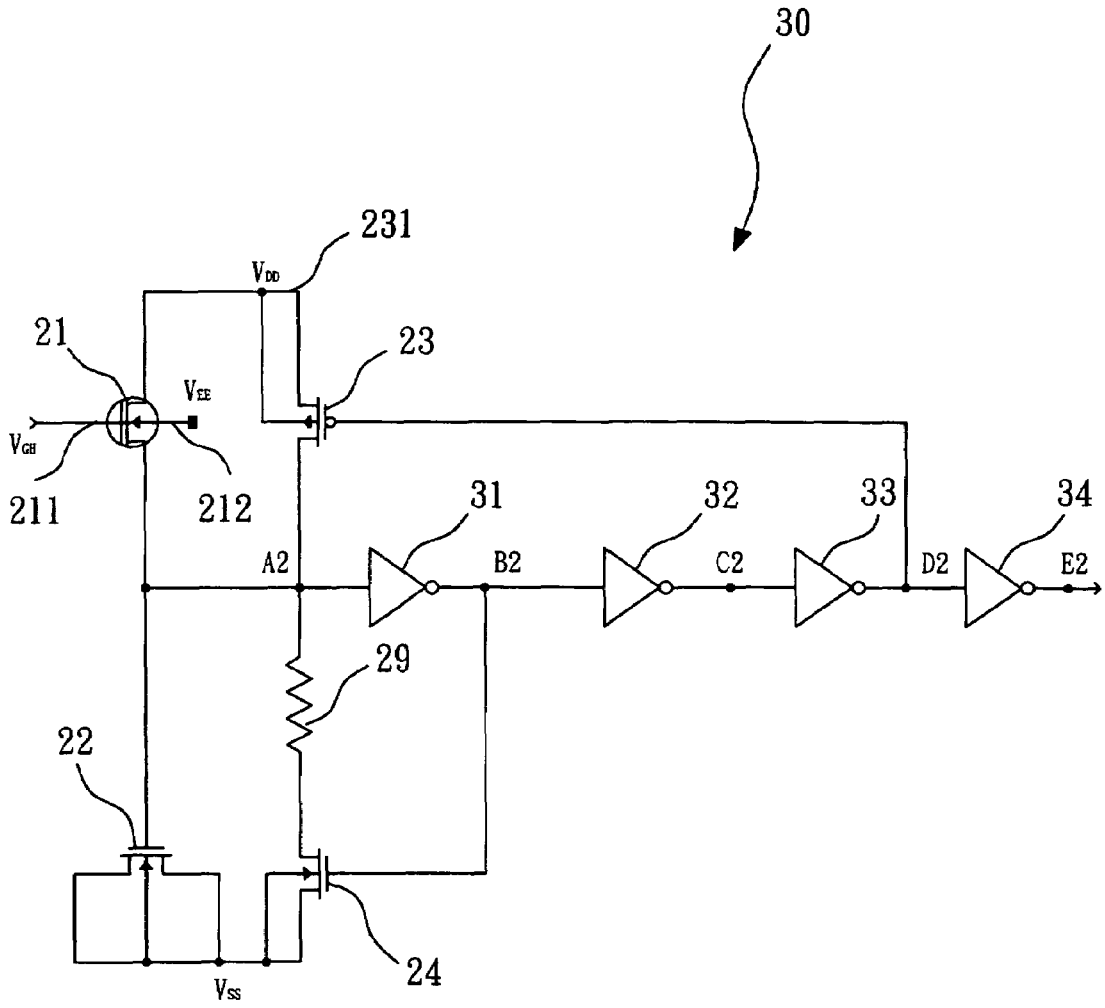
FIG. 5 is an equivalent circuit diagram of a reset device of a second embodiment of the present invention.

With reference to FIG. 5, it is an equivalent circuit diagram of the reset device 30 of the second embodiment of the present invention. The difference between the reset device 30 of the second embodiment and the reset device 20 of the first embodiment lies in that the reset device 30 utilizes four inverters: a first inverter 31, a second inverter 32, a third inverter 33 and a fourth inverter 34. The relationship of high and low level of a first control signal A2, a second control signal B2, a third control signal C2, a fourth control signal D2 and a fifth control signal E2 of the reset device 30 of the second embodiment is the same as that of the first to sixth control signal A1-E1 of the reset device 20 of the first embodiment, which will not be described herein.

Since the fifth control signal E2 is the reset signal, and its work voltage must meet the practical work voltage level, one of the first inverter 31, the second inverter 32, the third inverter 33 and the fourth inverter 34 must have a level elevated circuit for elevating the level of one of the second, third, fourth and fifth control signals to a work voltage level.

Furthermore, the PMOS transistor 23 is connected between the first control signal A2 and the fourth control signal D2, for maintaining the first control signal A2 at a high level when it is at high level, such that the reset signal (i.e. the fifth control signal E2) is maintained at a high level. Similarly, the function of generating the reset signal with the time sequence and amplitude control of a plurality of power supplies in FIG. 3 can be achieved according to the equivalent circuit in FIG. 5.

Figure 6:
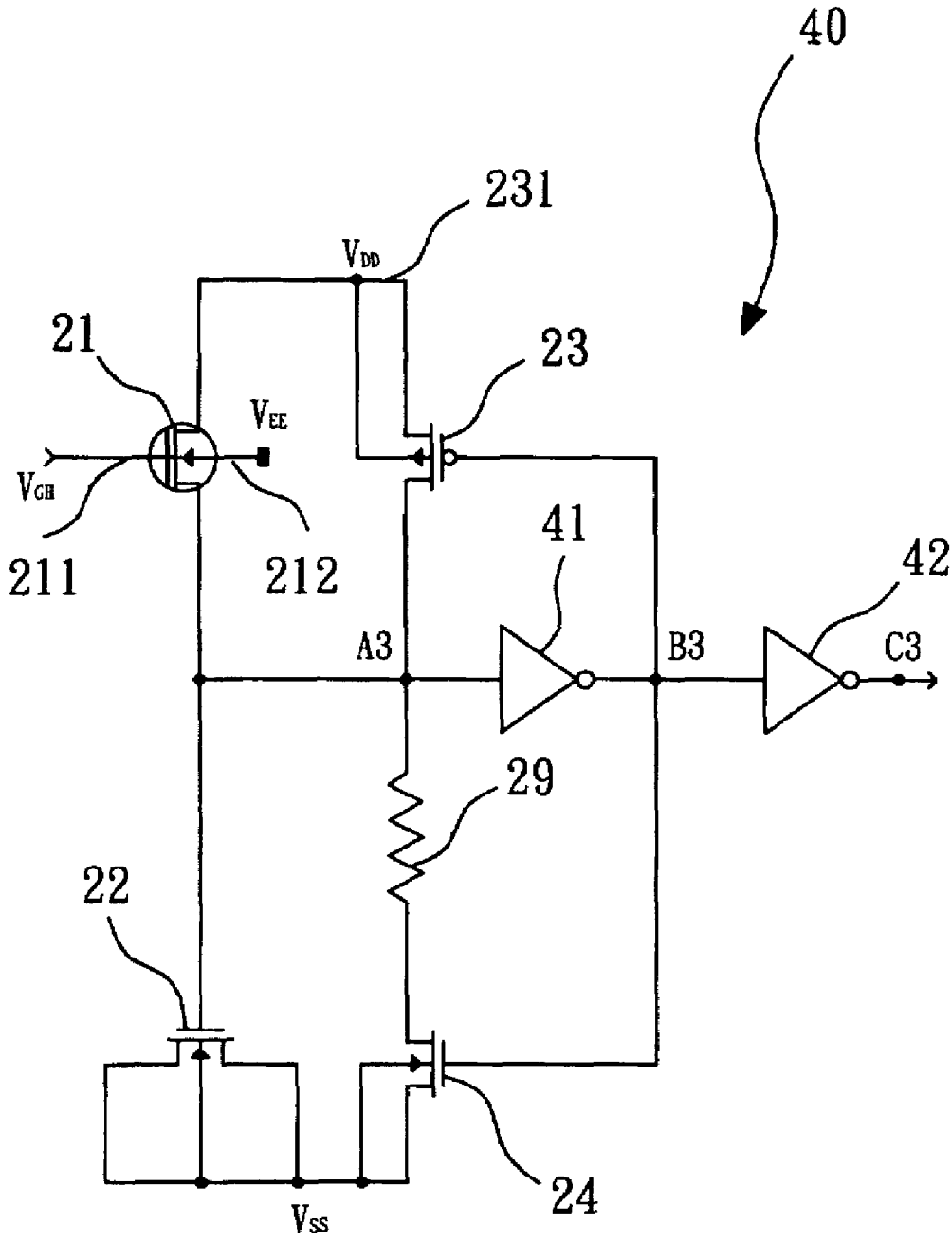
FIG. 6 is an equivalent circuit diagram of a reset device of a third embodiment of the present invention.

With reference to FIG. 6, it is an equivalent circuit diagram of the reset device 40 of the third embodiment of the present invention. The difference between the reset device 40 of the third embodiment and the reset device 30 of the second embodiment lies in that the reset device 40 only employs two inverters: a first inverter 41 and a second inverter 42. The relationship of high and low level of a first control signal A3, a second control signal B3 and a third control signal C3 of the reset device 40 of the third embodiment is the same as that of the first to third control signals A1-C1 of the reset device 20 of the first embodiment, which will not be described herein. Here, the third control signal C3 is the reset signal.

Since the third control signal C3 is the reset signal, and its work voltage must meet the practical work voltage level, one of the first inverter 41 and the second inverter 42 must have a level elevated circuit for elevating the level of one of the second and third control signals to a work voltage level.

Moreover, the PMOS transistor 23 is connected between the first control signal A3 and the second control signal B3, for maintaining the first control signal A3 at a high level state when it is high level, such that the reset signal (i.e. the third control signal C3) is maintained at a high level state. Similarly, the function of generating the reset signal with the time sequence and amplitude control of a plurality of power supplies in FIG. 3 can be achieved according to the equivalent circuit in FIG. 6.

Figure 7:
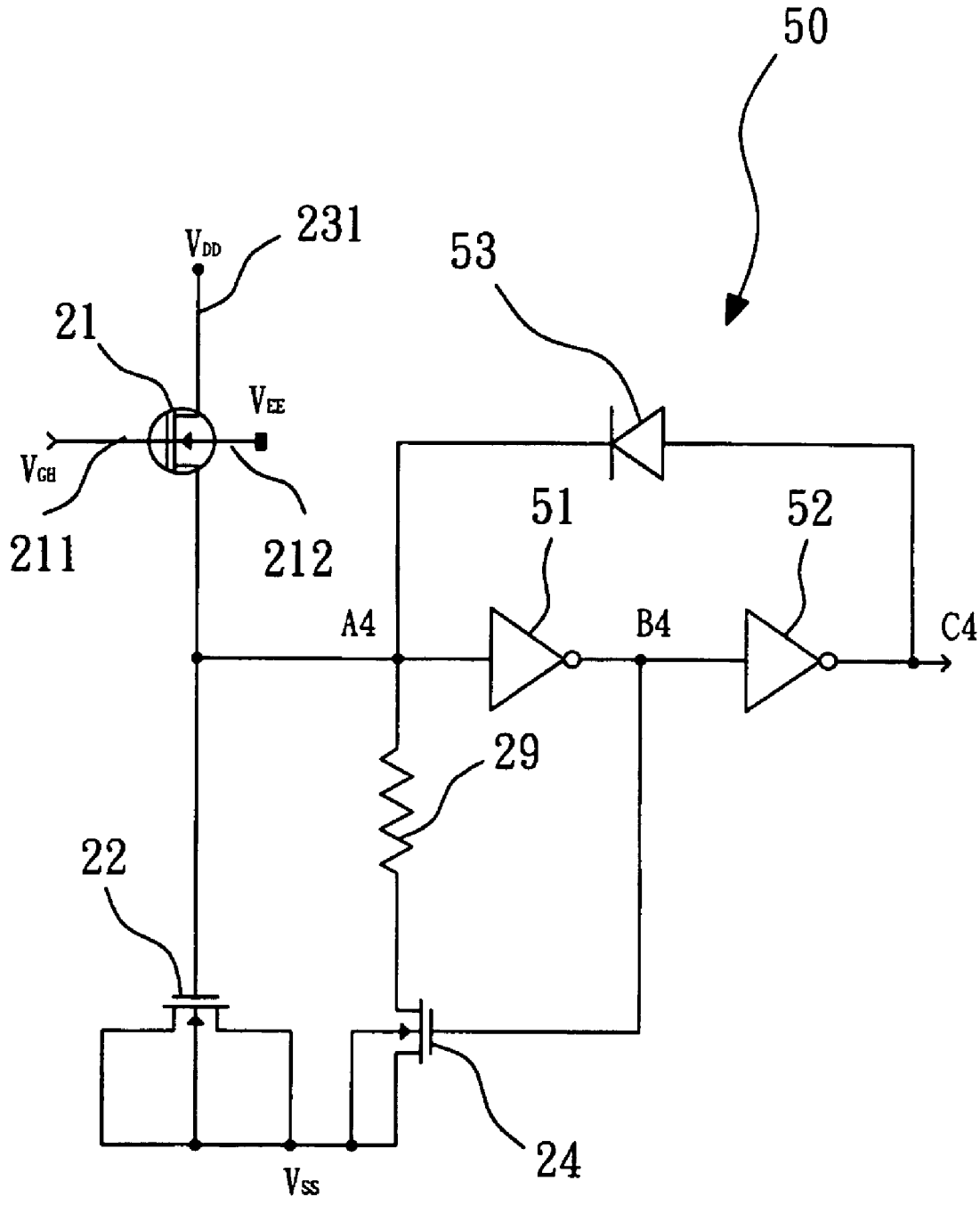
FIG. 7 is an equivalent circuit diagram of a reset device of a fourth embodiment of the present invention.

With reference to FIG. 7, it is an equivalent circuit diagram of the reset device 50 of the fourth embodiment of the present invention. The difference between the reset device 50 of the fourth embodiment and the reset device 40 of the third embodiment lies in that the reset device 50 employs two inverters: a first inverter 51, a second inverter 52, and a diode 53. The relationship of high and low level of a first control signal A4, a second control signal B4 and a third control signal C4 of the reset device 50 of the fourth embodiment is the same as that of the first to third control signals A1-C1 of the reset device 20 of the first embodiment, which will not be described herein. Here, the third control signal C4 is the reset signal.

Since the third control signal C4 is the reset signal, and its work voltage must meet the practical work voltage level, one of the first inverter 51 and the second inverter 52 must have a level elevated circuit for elevating the level of one of the second and third control signals to a work voltage level.

Moreover, the diode 53 is connected between the first control signal A4 and the third control signal C4 for maintaining the first control signal A4 at a high level when it is at high level, such that the reset signal (i.e. the third control signal C4) is maintained at a high level. The diode 53 can be used to replace the PMOS transistor 23 of the first to third embodiments, with the same effect as a retaining circuit. Similarly, the function of generating the reset signal with the time sequence and amplitude control of a plurality of power supplies in FIG. 3 can be achieved according to the equivalent circuit in FIG. 7.

Figure 8:
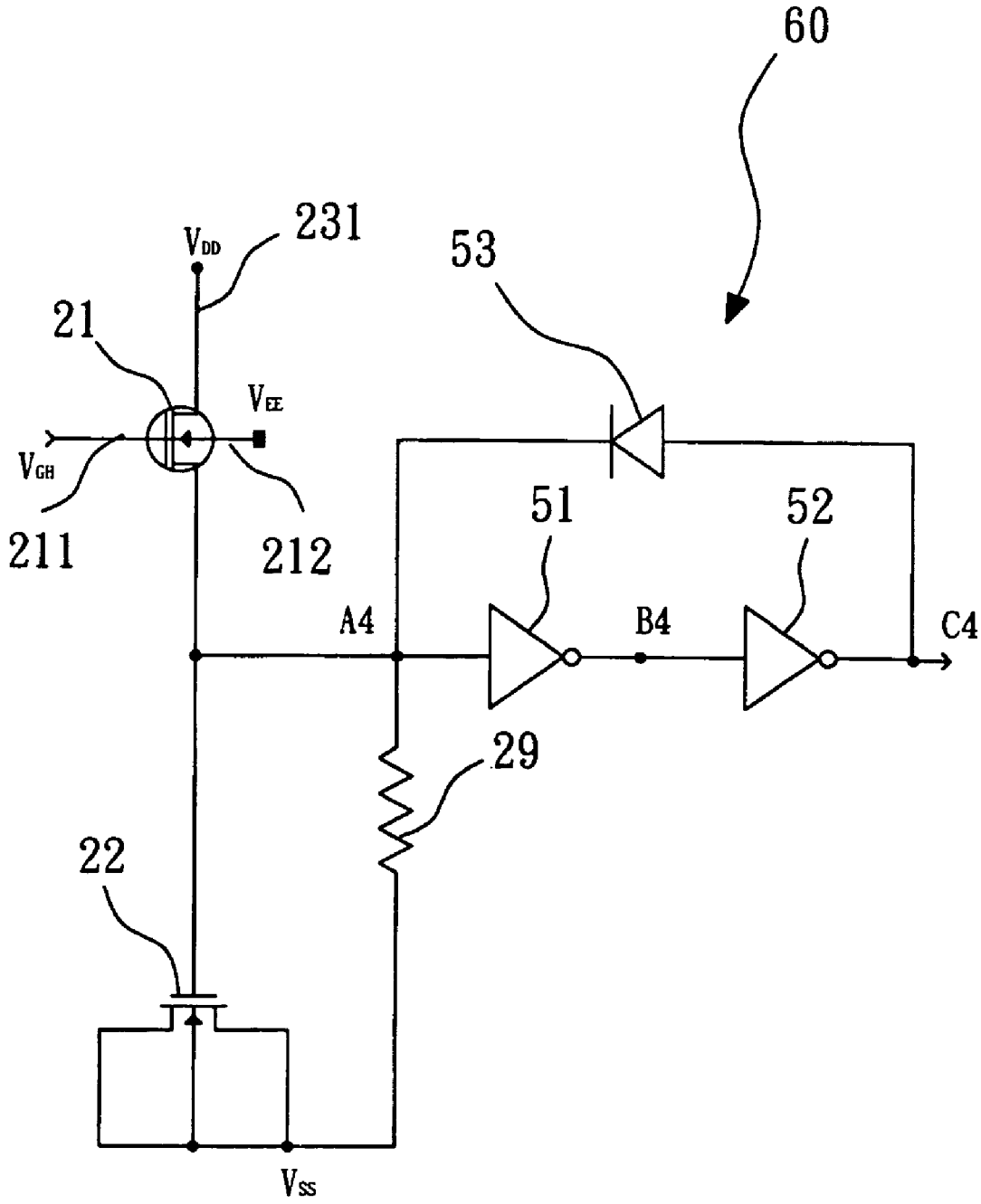
FIG. 8 is an equivalent circuit diagram of a reset device of a fifth embodiment of the present invention.

With reference to FIG. 8, it is an equivalent circuit diagram of the reset device 60 of the fifth embodiment of the present invention. The difference between the reset device 60 of the fifth embodiment and the reset device 50 of the fourth embodiment lies in that the reset device 60 excludes the second low voltage NMOS transistor 24 of the reset device 50 of the fourth embodiment, and it directly connects the resistor 29 to the ground terminal $V_{SS}$. Without the second low voltage NMOS transistor 24, the function of generating the reset signal with the time sequence and amplitude control of a plurality of power supplies in FIG. 3 can still be achieved according to the equivalent circuit in FIG. 8. Therefore, to simplify the circuit, the second low voltage NMOS transistor 24 of the reset device 20 of the first embodiment in FIG. 4, the reset device 30 of the second embodiment in FIG. 5 and the reset device 40 of the third embodiment in FIG. 6 can also be omitted, and the function of generating the reset signal with the time sequence and amplitude control of a plurality of power supplies in FIG. 3 can still be achieved.

Figure 9:
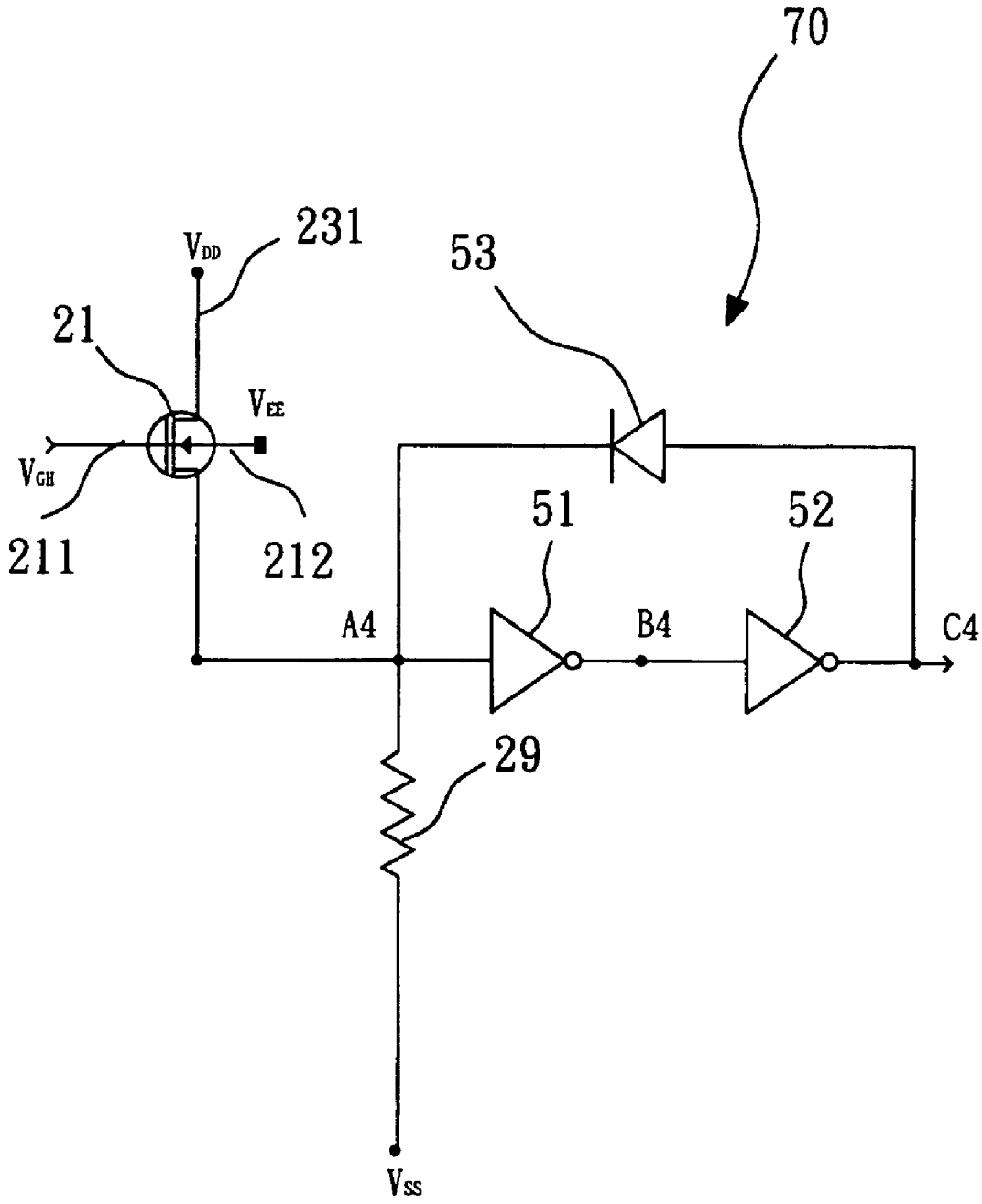
FIG. 9 is an equivalent circuit diagram of a reset device of a sixth embodiment of the present invention.

With reference to FIG. 9, it is an equivalent circuit diagram of the reset device 70 of the sixth embodiment of the present invention. The difference between the reset device 70 of the sixth embodiment and the reset device 60 of the fifth embodiment lies in that the reset device 70 excludes the first low voltage NMOS transistor 22 of the reset device 70 of the fifth embodiment. Without the first low voltage NMOS transistor 22, the function of generating the reset signal with the time sequence and amplitude control of a plurality of power supplies in FIG. 3 can still be achieved according to the equivalent circuit in FIG. 9. Thus, in order to further simplify the circuit, the first low voltage NMOS transistor 22 of the reset device 20 of the first embodiment in FIG. 4, the reset device 30 of the second embodiment in FIG. 5 and the reset device 40 of the third embodiment in FIG. 6 can also be omitted, and the function of generating the reset signal with the time sequence and amplitude control of a plurality of power supplies in FIG. 3 can still be achieved.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A reset device for a scan driver used for driving a control circuit of a display, comprising:

a first input terminal, for receiving a first input voltage;

a second input terminal, for receiving a second input voltage after the first input voltage is inputted to the first input terminal, wherein the second input voltage has a temporary section and a stable section, and the second input voltage at the stable section is larger than the first input voltage; and a reset circuit, for outputting a reset signal to the scan driver when the first input terminal receives the first input voltage, and clearing the reset signal when the second input voltage is larger than a threshold value at the temporary section.

2. A reset device according to claim 1, further comprising a retaining circuit for maintaining the reset signal at a clear state after the reset signal is cleared.

3. A reset device according to claim 1, wherein the reset circuit comprises:

a high voltage N-type metal oxide semiconductor (NMOS) transistor, having a gate connected to the second input terminal and a gate reference power supply terminal used for receiving a third input voltage that is the threshold value, wherein the on/off of the high voltage NMOS transistor is controlled by the second input voltage to obtain a first control signal;

a first low voltage NMOS transistor, connected to the high voltage NMOS transistor and used as a capacitor;

a first inverter, for inverting the first control signal to obtain a second control signal; and a second inverter, for inverting the second control signal to obtain a third control signal, the third control signal being the reset signal.

4. A reset device according to claim 3, wherein one of the first inverter and the second inverter further comprises a level elevated circuit for elevating the level of the second or third control signal to a work voltage level.

5. A reset device according to claim 3, further comprising a P-type metal oxide semiconductor (PMOS) transistor connected between the first control signal and the second control signal, for maintaining the first control signal at a high level state when the first control signal is at high level, such that the reset signal is maintained at the clear state of high level.

6. A reset device according to claim 5, further comprising a second low voltage NMOS transistor and a resistor connected between the first control signal and the second control signal.

7. A reset device according to claim 3, further comprising a diode connected between the third control signal and the first control signal, for maintaining the first control signal at a high level state when the first control signal is at high level, such that the reset signal is maintained at the clear state of high level.

8. A reset device according to claim 7, further comprising a second low voltage NMOS transistor and a resistor connected between the first control signal and the second control signal.

9. A reset device according to claim 1, wherein the reset circuit comprises:

a high voltage NMOS transistor, having a gate connected to the second input terminal and a gate reference power supply terminal used for receiving a third input voltage that is the threshold value, wherein the on/off of the high voltage NMOS transistor is controlled by the second input voltage to obtain a first control signal;

a first low voltage NMOS transistor, connected to the high voltage NMOS transistor and used as a capacitor;

a first inverter, for inverting the first control signal to obtain a second control signal;

a second inverter, for inverting the second control signal to obtain a third control signal;

a third inverter, for inverting the third control signal to obtain a fourth control signal; and a fourth inverter, for inverting the fourth control signal to obtain a fifth control signal, the fifth control signal being the reset signal.

10. A reset device according to claim 9, wherein one of the first inverter, the second inverter, the third inverter and the fourth inverter further comprises a level elevated circuit used for elevating the level of the second, third, fourth or fifth control signal to a work voltage level.

11. A reset device according to claim 9, further comprising a PMOS transistor connected between the first control signal and the fourth control signal, for maintaining the first control signal at a high level state when the first control signal is at high level, such that the reset signal is maintained at the clear state of high level.

12. A reset device according to claim 11, further comprising a second low voltage NMOS transistor and a resistor connected between the first control signal and the second control signal.

13. A reset device according to claim 1, wherein the reset circuit comprises:

a high voltage NMOS transistor, having a gate connected to the second input terminal and a gate reference power supply terminal used for receiving a third input voltage that is the threshold value, wherein the on/off of the high voltage NMOS transistor is controlled by the second input voltage to obtain a first control signal;

a first low voltage NMOS transistor, connected to the high voltage NMOS transistor and used as a capacitor;

a first inverter, for inverting the first control signal to obtain a second control signal;

a second inverter and level elevator, for inverting the second control signal to obtain a third control signal, and elevating the level of the third control signal to a work voltage level;

a third inverter, for inverting the third control signal to obtain a fourth control signal; and a fourth inverter, for inverting the fourth control signal to obtain a fifth control signal, the fifth control signal being the reset signal.

14. A reset device according to claim 13, further comprising a PMOS transistor connected between a output signal of the second inverter and level elevator and the first control signal, for maintaining the first control signal at a high level state when the first control signal is at high level, such that the reset signal is maintained at high level.

15. A reset device according to claim 14, further comprising a second low voltage NMOS transistor and a resistor connected between the first control signal and the second control signal.

16. A reset device according to claim 1, wherein the scan driver further comprises a plurality of registers and an output port set, the registers control the corresponding outputs of the output port set, and the reset signal is connected to the registers to reset the outputs of the output port set.

17. A reset device according to claim 1, wherein the scan driver further comprises at least one internal control signal and an output port set, the internal control signal controls the outputs of the output port set, and the reset signal controls the internal control signals to reset the outputs of the output port set.

18. A reset method for a scan driver used for driving a control circuit of a display, comprising the steps of:

(a) receiving a first input voltage;

(b) outputting a reset signal to the scan driver when receiving the first input voltage;

(c) receiving a second input voltage after the first input voltage is received, wherein the second input voltage has a temporary section and a stable section, and the second input voltage at the stable section is larger than the first input voltage; and (d) clearing the reset signal when the second input voltage is larger than a threshold value at the temporary section.

19. A reset method according to claim 18, further comprising a maintaining step for maintaining the reset signal at the clear state after the reset signal is cleared.

* * * * *